United States Patent [19]

Kato et al.

[11] Patent Number: 4,634,918

[45] Date of Patent: Jan. 6, 1987

[54] CATHODE RAY TUBE APPARATUS WITH LIQUID COOLED FRONT PANEL

[75] Inventors: Hiroshi Kato, Kawasaki; Tomosuke Chiba, Matsudo; Masahiro Kikuchi, Shinagawa, all of Japan

[73] Assignee: Sony Corporation, Tokyo, Japan

[21] Appl. No.: 667,496

[22] PCT Filed: Feb. 22, 1984

[86] PCT No.: PCT/JP84/00062

§ 371 Date: Oct. 18, 1984

§ 102(e) Date: Oct. 18, 1984

[87] PCT Pub. No.: WO84/03390

PCT Pub. Date: Aug. 30, 1984

[30] Foreign Application Priority Data

Feb. 24, 1983 [JP] Japan ..... 58-29809

[51] Int. Cl.[4] ..... H01J 29/86; H01J 7/24

[52] U.S. Cl. ..... 313/36; 313/44; 313/45; 313/477 R

[58] Field of Search ..... 313/477 R, 36, 44, 45; 358/237, 242

[56] References Cited

U.S. PATENT DOCUMENTS 4,405,949 9/1983 Hockenbrock et al. ..... 358/237
4,529,905 7/1985 Ohkoshi et al. ..... 313/477 R X
4,543,510 9/1985 Chiba et al. ..... 313/477 R

FOREIGN PATENT DOCUMENTS 2124425 2/1984 United Kingdom ..... 313/477 R

*Primary Examiner*—Palmer C. DeMeo
*Attorney, Agent, or Firm*—Hill, Van Steadman, Steadman & Simpson

[57] ABSTRACT

In this invention, disposed in front of a front panel (1*a*) of a cathode ray tube (1) is a transparent panel (2) through a metal spacer (3) which serves also as a heat radiator, a liquid tight space (5) is formed between the front panel (1*a*) and the transparent panel (2), a transparent liquid coolant (6) is sealed in the space (5), a protruded portion (3C) is provided on at least the upper end portion of the transparent panel (2) and an extended space (5A) into which the liquid coolant is injected is formed between the protruded portion and the metal spacer (3), whereby it is possible to effectively radiate the heat generated in the front panel (1*a*) of the cathode ray tube (1).

3 Claims, 14 Drawing Figures

| | $(\overline{T_L - T_0})$ | Transparent Panel | | Metal Frame | |
|---|---|---|---|---|---|
| | | Heat Radiating Area | Heat Absorbing Area | Heat Radiating Area | Heat Absorbing Area |
| Prior Art Example | 40°C | 107cm² | 79cm² | 128cm² | 10cm² |
| Comparative Example | 36°C | 107cm² | 79cm² | 128cm² | 28cm² |
| Example | 33°C | 125cm² | 89cm² | 118cm² | 38cm² |

CATHODE RAY TUBE APPARATUS WITH LIQUID COOLED FRONT PANEL

TECHNICAL FIELD

The present invention relates to a liquid cooling type cathode ray tube apparatus and more particularly to a liquid cooling type cathode ray tube apparatus suitable for use with a cathode ray tube of a high brightness which is used in, for example, a color video projector.

BACKGROUND ART

In a cathode ray tube of high brightness, a reproduced optical image of high brightness is formed by increasing the energy of an electron beam which impinges upon its phosphor screen.

Heat generated in the phosphor screen when an electron beam of high energy impinges on the phosphor screen or in addition thereto heat generated in such a case when the electron beam impinge on an electron beam landing position determining electrode such as a shadow mask, an aperture grille or the like which is disposed in opposing relation to the phosphor screen within a tube envelope so as to restrict the electron beam landing position relative to the phosphor screen becomes considerably great as the energy of the electron beam is increased. However, the front panel or glass panel of the cathode ray tube envelope on which the phosphor screen is formed is low in thermal conductivity so that particularly in the continuous driving of the cathode ray tube, the rise of temperature at the central portion of the glass panel which is difficult to radiate its heat becomes significant. As a result, a so-called thermal quenching takes place in the phosphor. The thermal quenching is such a phenomenon that as the temperature rises, the brightness of the phosphor is lowered. Since the degree of thermal quenching is different depending on the phosphors of respective colors, white balance becomes out of order.

The disorder of the white balance at the center of the front panel much deteriorates the picture quality so that, upon continuous driving of the cathode ray tube, in order to establish the white balance at the center of the front panel, it may be considered to adjust the brightness of the optical images of the respective colors. In this case, there occur such defects that the white balance on the peripheral portion of the front panel is destroyed and that the brightness of the whole portion can not be increased.

Such problem becomes serious in either case of a color projector in which, for example, picture images of respective colors obtained from respective monochromatic cathode ray tubes are projected in mixed state on a screen to produce a color picture image thereon or a color picture image formed of picture images of a plurality of colors is produced from the same cathode ray tube and then projected onto the screen.

Therefore, in the cathode ray tube of this kind, in order to prevent the temperature from rising to such an extent that the thermal quenching takes place on the phosphor screen even upon continuous driving thereof, its front panel must be cooled. This cooling may be carried out by using a cooling fan. In this case, the cooling fan, however, sends not only air but also dusts to the surface of the front panel of the tube envelope. Then, the dusts adhere to the panel surface to cause an apparent deterioration of brightness. In this case, there occurs also a problem of a noise of the cooling fan.

To avoid the above shortcomings, a cathode ray tube apparatus was proposed in which a transparent liquid coolant, particularly a liquid capable of easily causing convection is disposed in contact with the front panel of the tube envelope to cool the front panel.

Such liquid cooling type cathode ray tube apparatus, particularly a cathode ray tube apparatus of a closed convection type is shown in FIG. 1, for example, as a partially cross-sectional side view. Such cathode ray tube apparatus comprises a tube envelope 1, a front panel 1*a* of flat plate shape on the inner surface of which a phosphor screen 7 is deposited, a flat plate shaped transparent panel 2 having optical transmissivity made of glass and opposed to the front panel and a metal spacer 3 of annular frame shape having excellent thermal conductivity interposed between both the panels 1*a* and 2. The spacing between the panels 1*a* and 2 is determined by the metal spacer 3. The frame-shape metal spacer 3, the outer surface of the panel 1*a* and the inner surface of the panel 2 are bonded one another by a resinous bonding agent, for example, a silicone resin 4 and also are sealed in liquid tight to form a liquid tight space 5 between the panels 2 and 1*a*. Sealed and filled within this liquid tight space 5 is a transparent liquid coolant 6 which easily causes convection.

Upon use, the tube envelope 1 thus made is so located that its panel 1*a* is disposed in substantially the vertical direction or inclined obliquely.

In this case, the liquid coolant 6 filled into the closed space 5 directly contacts with the outer surface of the front panel 1*a* within the tube envelope 1 thereby thermally coupled in tight to the outer surface of the front panel. Therefore, according to such configuration, when the temperature of the panel 1*a* rises, the liquid coolant 6 is effectively heated by the panel 1*a*. Then, the liquid coolant 6 thus heated is moved upwards to cause convection within the space 5. Thus, even the heat in, for example, the central portion of the panel 1*a* is effectively carried to the peripheral portion of the panel and conducted to the metal spacer 3 having excellent thermal conductivity made of, for example, aluminium which is disposed in the above peripheral portion. The heat is then conducted throughout the metal spacer 3 and then radiated from the outer peripheral portion of the metal spacer which is in contact with the open air or a heat radiating path such as a chassis or the like.

According to the cathode ray tube apparatus thus made, the rise of temperature in the panel 1*a* can be suppressed relatively effectively.

However, recently, in a video projector for example, its cathode ray tube has been requested to have high brightness, high resolution and high power as the brightness is increased, thus the more and more effective heat radiation being requested. If in accordance with the increase of power (power P is given by an equation, $P = Vp \times Ik$ where Vp is anode voltage (acceleration voltage) and Ik is cathode current), its acceleration voltage is increased, the front panel of the tube envelope 1 must increase its thickness so as to avoid the increase of transmittance amount of X-ray. However, in the video projector, when a lens, particularly a plastic lens is used in its optical system, from a lens designing view point, it is not possible to increase the distance between the phosphor screen 7 and the lens, namely, the thickness of the front panel 1*a* so much. In this case, it is therefore employed such a method that in the glass material of the transparent panel 1*a*, the containing amount of, for example, lead which has a shield effect against X-ray is increased. However, such glass containing a large amount of lead is lowered in hardness and becomes a property apt to be scarred easily. Accordingly, in this case, when the temperature rises and a deformation such as bend and the like due to thermal expansion occurs in the transparent panel 2, the transparent panel is particularly broken easily. Therefore, as the brightness is improved to be high, the heat radiation and cooling are requested to become more effective.

For this reason, in the prior art cathode ray tube apparatus thus constructed as, for example, shown in FIG. 1, a heat radiating fin 8, for example, is provided to increase the surface area which contacts with the air. However, the heat radiation is not so effectively carried out by such countermeasure. As a result of various experiments and considerations, the present inventors have clarified the reason for the above defect that the heat of the liquid coolant 6 is not effectively conducted to the metal spacer 3. That is, practically the metal spacer 3 is bonded in liquid tight to the panels 2 and 1*a* at the both outer and inner surfaces of the portion interposed between both the panels 2 and 1*a* by the resin 4 so that the area of the metal spacer 3 which contacts with the liquid coolant 6 is small and hence the heat of the liquid coolant 6 is not effectively conducted to the metal spacer 3.

On the basis of this clarification, the present applicant has previously proposed a cathode ray tube apparatus in which heat of a liquid coolant can be effectively conducted to a metal spacer as a Japanese patent application No. 101550/1982. FIG. 2 shows an example of such cathode ray tube apparatus, and in FIG. 2, like parts corresponding to those in FIG. 1 are marked with the same references. In this case, the metal spacer 3 is provided at its inner periphery with an inner peripheral protruded portion 3*e* of a plate shape which is thinner than other portions. This inner peripheral protruded portion is immersed into the liquid coolant 6 sealed within the space 5 and directly contacts therewith whereby to increase the area in which the metal spacer 3 contacts with the coolant 6.

When the metal spacer 3 is provided at its inner periphery with the protruded portion 3*e* which is immersed into the liquid coolant 6, the efficiency in which the heat of the liquid coolant 6 is conducted to the metal spacer 3 is increased but this inner peripheral protruded portion 3*e* must be disposed outside the effective picture screen around the picture screen of the cathode ray tube, thus the area of the inner peripheral protruded portion 3*e* being restricted.

Further in practice, when the cathode ray tube type projector is constructed, as shown by its schematic cross-sectional view in FIG. 3, a lens system 9 is disposed in opposing relation to the transparent panel 2 of the above cathode ray tube apparatus. This lens system 9 is fixed such that its mirror cylinder 10, for example, is fixed to a lens holder 11 of cylinder shape disposed on the front periphery of the tube envelope 1 by screwing, for example, three attaching leg pieces 12 extended to the outside from the end portion of the mirror cylinder 10. The lens holder 11 is provided at its rear end with a flange portion which is fixed to a chassis 13 together with the metal spacer 3. According to the configuration thus made, while the heat from the tube envelope is directly radiated from the outer periphery of the tube envelope itself, heat is radiated from the metal spacer 3 to the chassis 13 and further heat is radiated to the air from the surfaces on which the metal spacer 3 and the transparent panel 2 contact with the air. Although the metal spacer 3 and the transparent panel 2 are surrounded by the lens system 9 and the lens holder 11, this surrounded space is communicated with the air through the clearance provided between the periphery of the lens mirror cylinder 10 and the lens holder 11. Thus, heat is radiated thereby and heat is radiated also from the lens holder 11 made of metal. However, when the lens system is provided opposing to the cathode ray tube as set forth above, if a bright lens the so-called F number of which is small is used as this lens system, it is desired that the distance between the lens system and the picture image on the cathode ray tube, namely, the spacing between the lens system 9 and the front panel 1*a* of the tube envelope 1 is made as small as possible, thus the thickness of the metal spacer 3, the thickness of the liquid coolant 6, the thickness of the transparent panel 2 and the like being restricted, respectively. Further, when the temperature of the liquid coolant 6 rises, in order to prevent the panel 2 from being deformed and broken by the thermal expansion of the liquid coolant and to prevent the liquid tight condition of the portion sealed by the resin 4 from being damaged to cause the liquid to escape, it is desired that the volume of the liquid coolant, accordingly, the thickness of the coolant 6 is made small. In accordance therewith, the thickness of the metal spacer 3 is reduced. Accordingly, in order to enhance the cooling effect of the cooling by the liquid of closed convection type, further consideration has to be made. By way of example, when a plastic lens is used as the lens system, the plastic lens having an F number as small as about 1.0 can be prepared. In this case, in the cathode ray tube of 7-inch type, the distance between the lens system 9 and the front panel 1*a* of the cathode ray tube becomes as, for example, about 20 mm. Further, there is a spatial restriction due to the provision of the lens holder 11. In addition, when cathode ray tubes of red, green and blue colors are arranged just like, for example, a 3-tube type projector, in order to make the whole of the apparatus small, the above spatial restriction becomes more severe. As a result, the increase of the surface area or the like of the metal spacer or the like so as to effectively radiate the heat from the liquid coolant 6 is restricted.

In the liquid cooling closed convection type cathode ray tube which is applied as the cathode ray tube having high brightness for use with the projector of, for example, color cathode ray tube type, this invention is to further improve the heat radiating effect regardless of the above restrictions.

DISCLOSURE OF INVENTION

According to this invention, a metal spacer of frame shape serving as a heat radiator is disposed around the periphery of an effective picture screen on an outer surface of a front panel of a cathode ray tube envelope, a transparent panel is opposed through this metal spacer to the front panel of the above cathode ray tube envelope with a distance determined by the metal spacer to thereby form a liquid tight space between the front panel and the transparent panel and a transparent liquid coolant is sealed into this liquid tight space. Then, the inner periphery of the metal spacer directly contacts with the transparent liquid coolant accommodated into the above liquid tight space over substantially whole periphery thereof. Provided on at least the upper end side of the transparent panel is a protruded portion which is protruded upwards from the position corresponding to the upper end of the front panel of the cathode ray tube envelope. And, formed between the protruded portion and the metal spacer is a liquid tight extended space extended from the above liquid tight space into which the transparent liquid coolant is filled.

Further, a heat radiation fin is provided on the outer peripheral portion of the metal spacer.

In addition, the metal spacer is provided with a liquid coolant injection inlet of L-shape which is formed of a portion substantially in parallel to the front panel and a portion communicated with the above portion and substantially in perpendicular to the front panel.

BEST MODE FOR CARRYING OUT THE INVENTION

Figure 1:
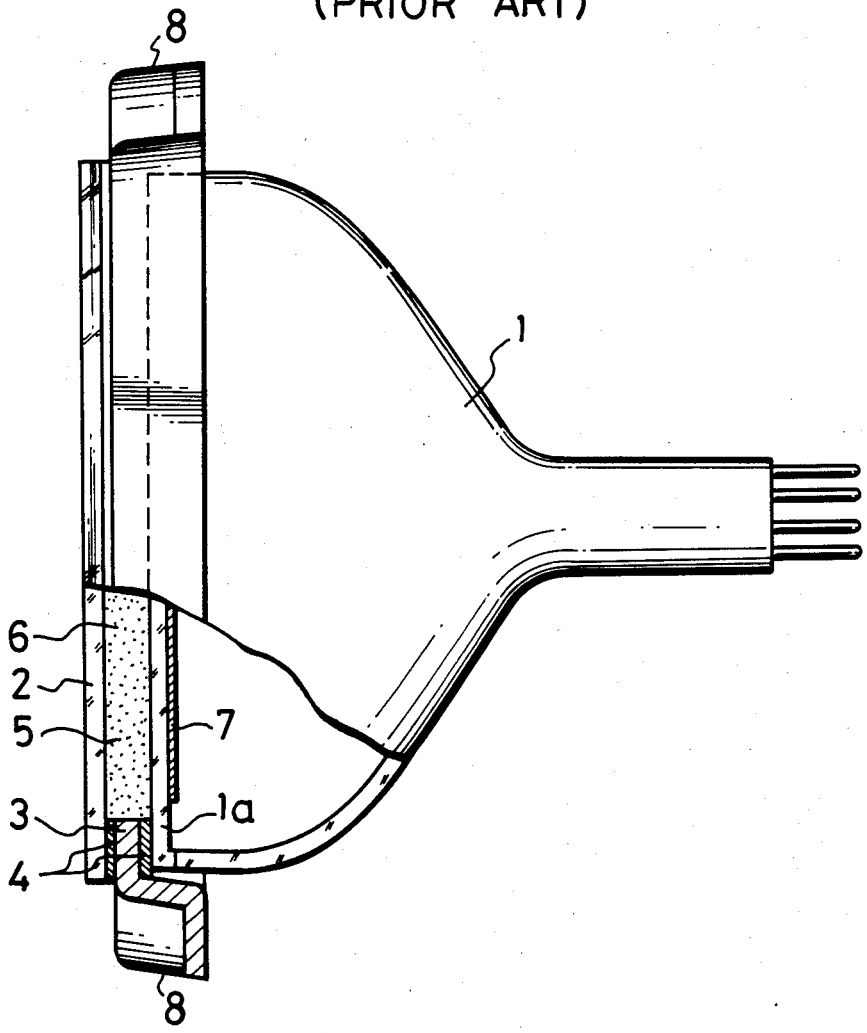
FIG. 1 (PRIOR ART)
FIG. 1 is a partially cross-sectional side view of a prior art cathode ray tube apparatus.
Figure 2:
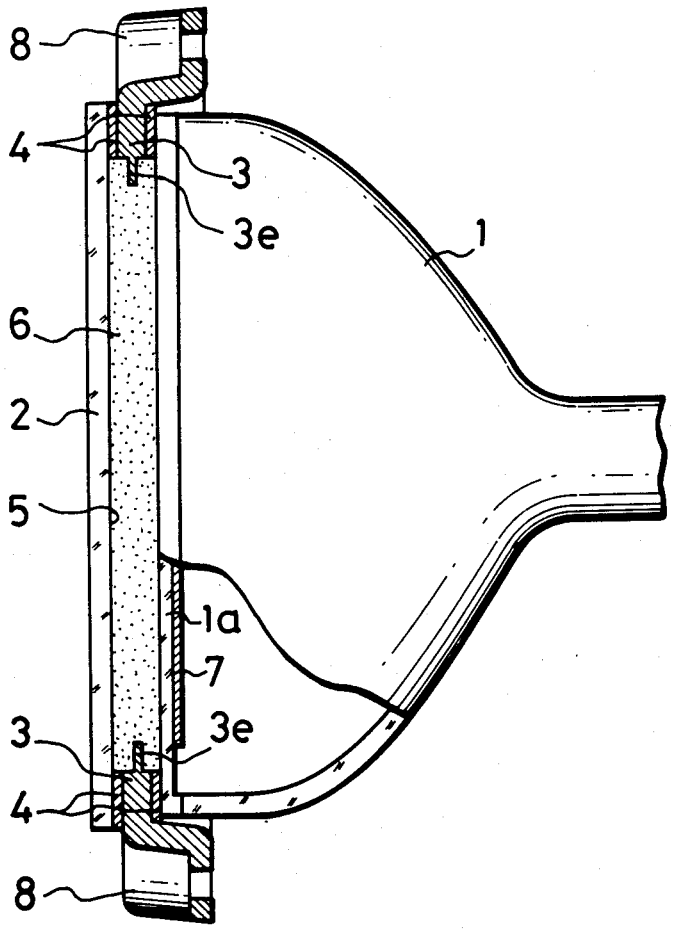
FIG. 2 (PRIOR ART)
FIG. 2 is a partially cross-sectional side view of a cathode ray tube apparatus which is to be compared with the present invention.
Figure 3:
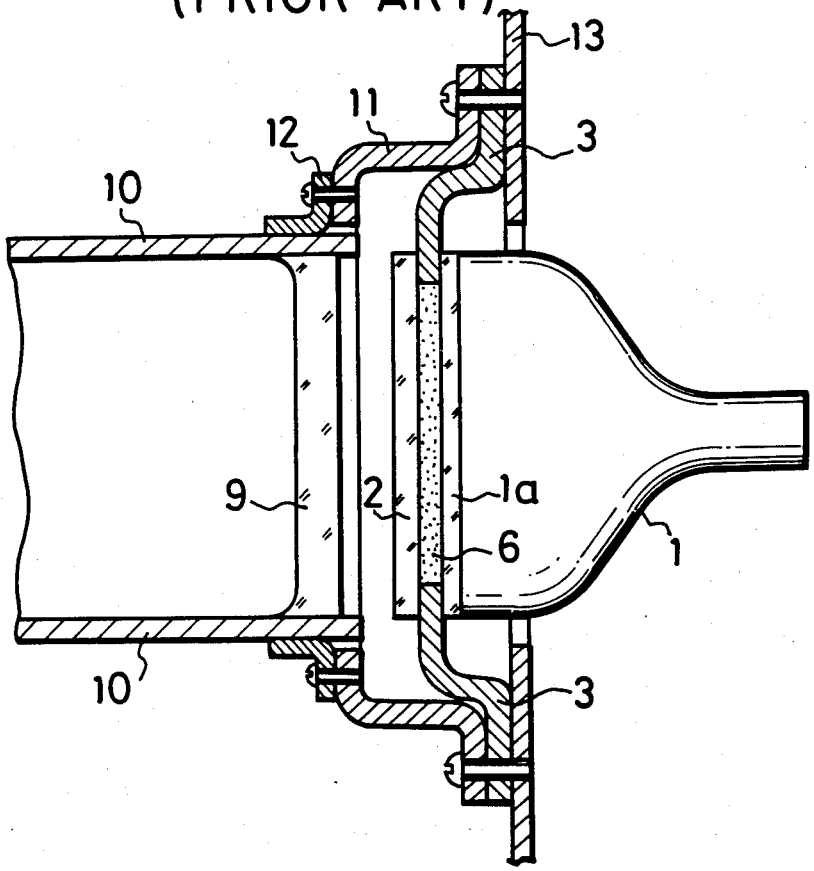
FIG. 3 (PRIOR ART)
FIG. 3 is a cross-sectional diagram showing the prior art cathode ray tube apparatus in such a state that a lens system is attached thereto.
Figure 4:
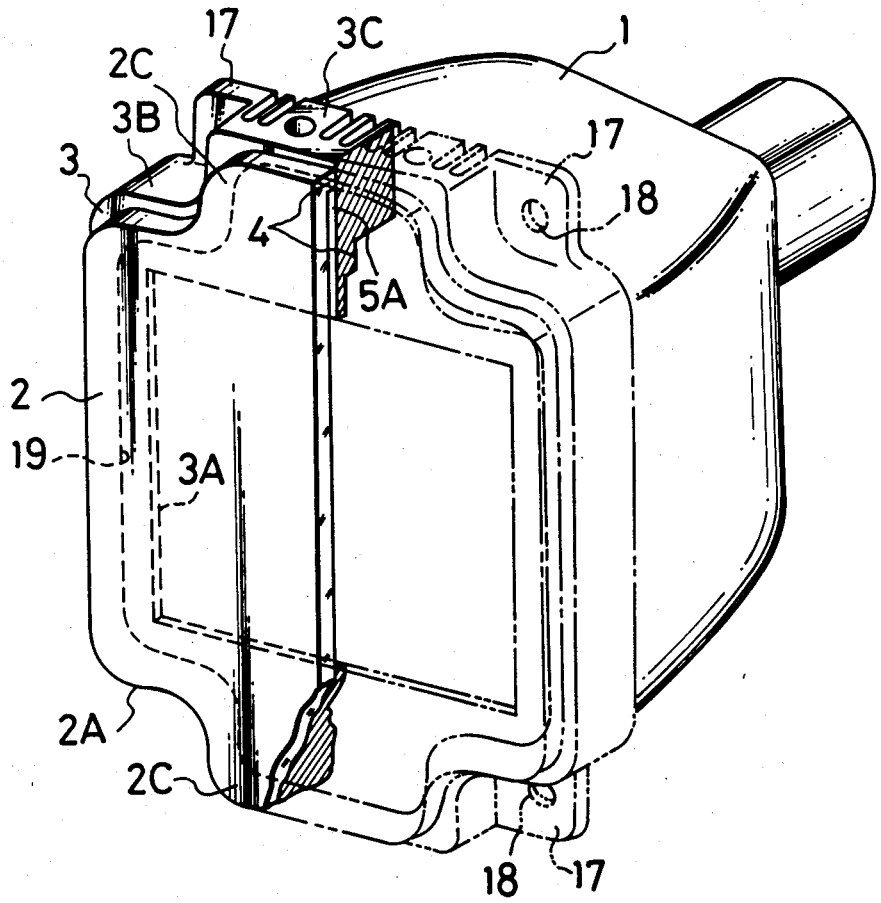
FIG. 4 is a partially cut-out perspective view of an embodiment of a cathode ray tube apparatus according to the present invention.

An embodiment of this invention will be described with reference to FIG. 4 and the followings. In FIG. 4 and the followings, like parts corresponding to those in FIGS. 1 to 3 are marked with the same references.

Figure 5:
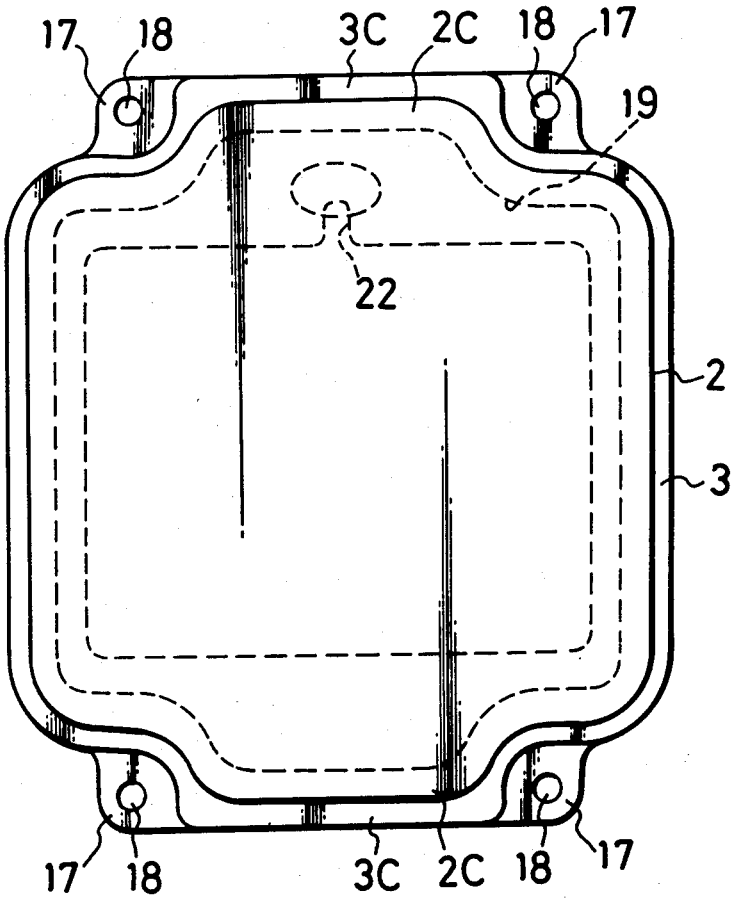
FIG. 5 is a front view thereof.
Figure 6:
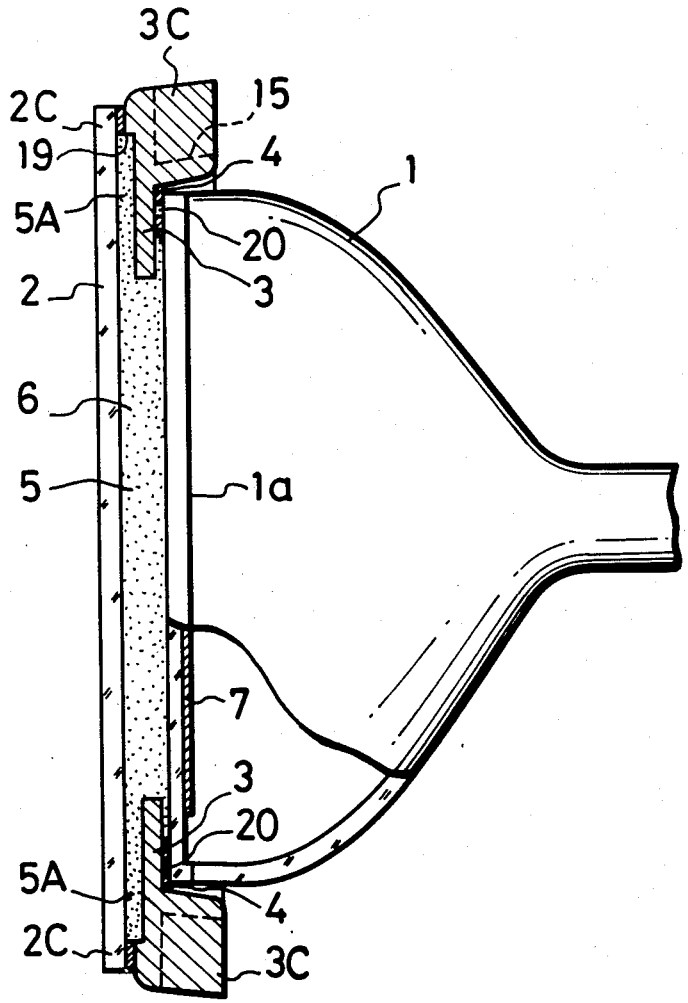
FIG. 6 is a partially cross-sectional side view thereof.
Figure 7:
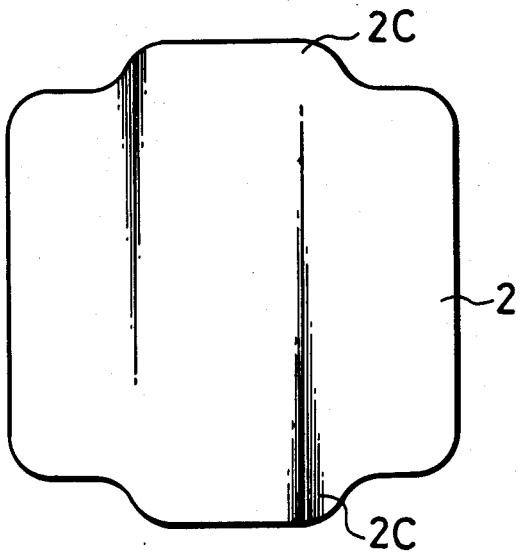
FIG. 7 is a front view of an example of the transparent panel used therein.

In this invention, as shown in FIGS. 4 to 6, the frame-shape metal spacer 3 is located around the periphery of the effective picture screen on the outer surface of the front glass panel 1*a* of, for example, the glass cathode ray tube envelope 1 on the inner surface of which the phosphor screen 7 is formed similarly as before. Through this metal spacer 3, the transparent panel 2 such as a glass plate and the like is opposed to the front panel 1*a* with a predetermined distance therebetween whereby to form the liquid tight space 5 between both the panels 2 and 1*a*. Particularly in this invention, as shown in FIG. 7, formed on at least the upper side edge (the upper side edge in the present specification denotes the upper side portion under being disposed when the cathode ray tube is used) of the transparent panel 2 is a protruded portion 2C which is protruded upwards from the position corresponding to the upper side edge of the front panel 1*a* of the cathode ray tube envelope 1. Practically, in the cathode ray tube apparatus of this kind, the up and down direction thereof is desirably selected and assembled to be, for example, a projector so that the protruded portions 2C which are protrusively symmetrical to each other are formed on the upper and lower edges of the panel 2.

Figure 8:
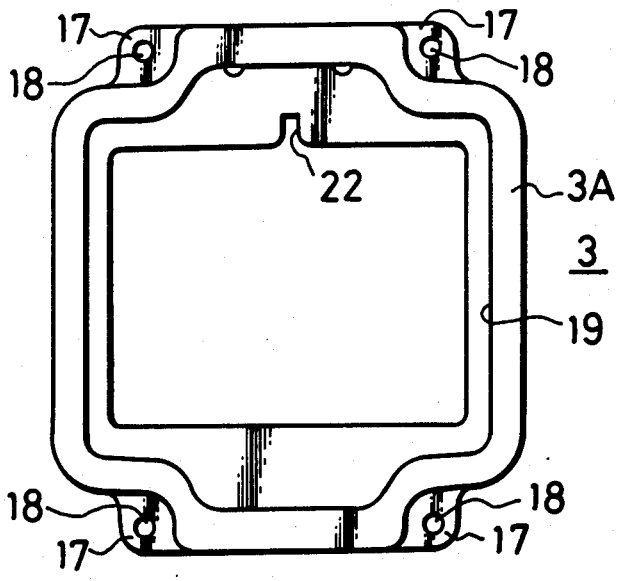
FIG. 8 is a front view of an example of the metal frame used therein.
Figure 9:
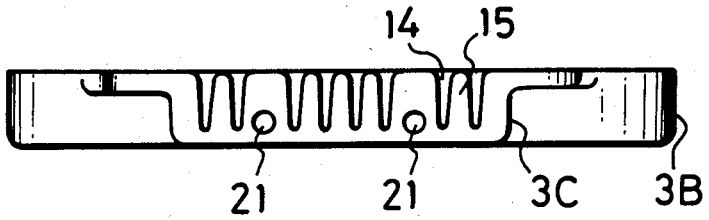
FIGS. 9 and 10 are respectively a top view and a rear view thereof.
Figure 10:
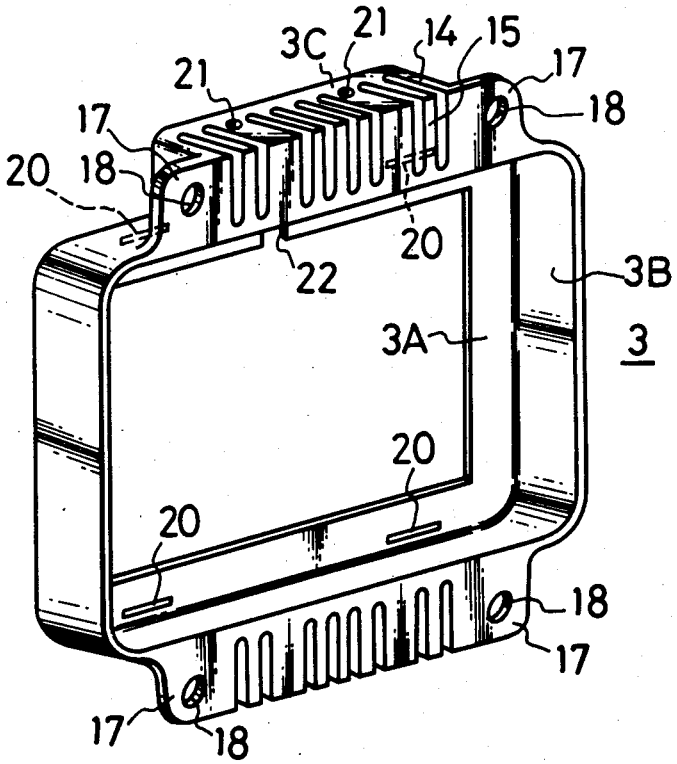

The metal spacer 3 is formed by the die-casting of, for example, aluminium. As shown in Figs.8 to 10, the metal spacer 3 consists of a frame-shape portion 3A which is interposed between the front panel 1*a* of the cathode ray tube envelope 1 and the transparent panel and an annular-shaped peripheral wall surface 3B which is bent rearward along the peripheral surface of the tube envelope 1. This annular-shaped peripheral wall surface 3B is provided at its upper and lower portions with protruded portions 3C which are protruded to the up and down directions. The frame-shaped portion 3A has an outer peripheral configuration corresponding to the configuration of the panel 1*a* and an inner peripheral shape corresponding to the configuration of the effective picture screen of the cathode ray tube envelope 1. The upper and lower protruded portions 3C have a thickness corresponding to the width of the annular peripheral wall surface 3B in its axial direction and are provided with a plurality of grooves 14 which are extended over the upper and lower outer surfaces and the rear surface thereof. Heat radiating fins 15 are formed between the grooves 14. The front surfaces of the upper and lower protruded portions 3C are arranged to form the same planes with the front surface of the frame-shaped portions 3A. Reference numerals 17 designate flange portions which are respectively protruded to both of right and left sides of the respective upper and lower protruded portions 3C of the metal spacer 3. Bored through the flange portions 17 are insertion apertures 18 into which mounting screws and the like are inserted so as to mount the metal spacer 3 on a fixed portion, for example, a chassis.

The front portion, namely, the front panel 1*a* of the cathode ray tube envelope 1 is inserted into this metal spacer 3 and the resin 4 having bonding property such as silicone resin or the like is interposed between the inner surface of the frame-shaped portion 3A and the periphery of the front panel 1*a* over the whole periphery of the panel 1*a*, thus the frame-shaped portion 3A and the panel 1*a* being bonded together in liquid tight. Further, the transparent panel 2 is opposed to the front surface of the metal spacer 3 and the like resin 4 having bonding property is interposed between the panel 2 and the front surface of the metal spacer 3 over the whole periphery of the panel 2, thus the metal spacer 3 and the panel 2 being bonded together in liquid tight. As described above, formed between the panels 1*a* and 2 is the liquid tight space 5 which is surrounded by the metal spacer 3 and sealed by the bonding property resin 4.

The positional relation between the upper and lower protruded portions 3*c* of the metal spacer 3 and the upper and lower protruded portions 2*c* of the transparent panel 2 is determined in advance such that they are opposed to one another under the above bonded state. Although the configuration of the transparent panel 2 is formed so as to correspond to the configuration of the metal spacer 3, it is selected to be a little smaller than the configuration of the metal spacer 3. On the front surface of the metal spacer 3, namely, its surface opposing to the transparent panel 2 except the peripheral edge portion of the transparent panel 2 bonded by the bonding resin 4 and inside thereof, formed is a concave portion 19. Thus, outside the effective picture screen of the cathode ray tube envelope 1 to surround, for example, its periphery, a clearance is formed between the transparent panel 2 and the metal spacer 3, particularly between the protruded portions 2C and 3C in which an extended space 5A is formed which is extended from the liquid tight space.

Also, on the inner surface of the frame-shape portion 3A of the metal spacer 3, namely, on the side facing to the front panel 1*a* of the tube envelope 1, a clearance is formed between the inner peripheral portion of the frame-shape portion 3A and the panel 1*a* by the thickness of the bonding resin 4 which is interposed between the frame-shape portion 3A and the panel 1*a*. In order to restrict the thickness of the bonding resin 4 interposed between the metal spacer 3 and the panel 1*a* so as to form such clearance, protrusions 20 abutting the panel 1*a* are formed on the inner surface of the frame-shape portion 3A of the metal spacer 3.

The transparent liquid coolant 6, for example, ethylene glycol aqueous solution is injected and filled into the liquid tight space 5 including the extended space 5A. Thus, the inner peripheral portion of the frame-shape portion 3A of the metal spacer 3 is immersed into the liquid coolant 6 over a predetermined width. Also, particularly due to the existence of the extended space 5A, the liquid coolant 6 enters between the upper and lower extended portions 2*c* of the transparent panel 2 and the upper and lower extended portions 3*c* of the metal spacer 3 except the outer peripheral portions sealed by the resin 4, thus the metal spacer 3 and the panel 2 contacting with the coolant 6, too.

The injection of the coolant 6 into the space 5 is carried out through injection inlets 21 which are formed through the thick portions between the grooves 14 in the protruded portions 3C of the metal spacer 3 so as to communicate with the space 5.

Figure 11:
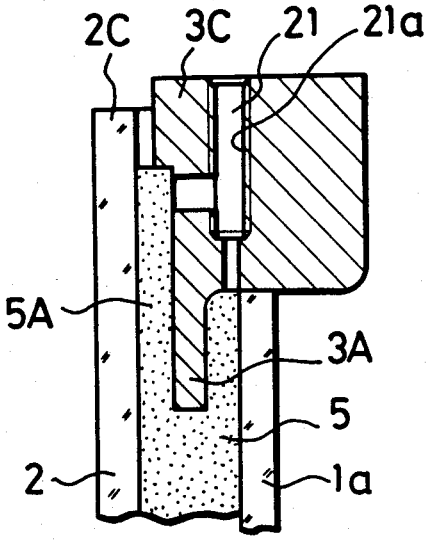
FIG. 11 is a cross-sectional view of a main part of the apparatus according to the present invention.

As, for example, shown in FIG. 11, this injection inlet 21 may be formed as an L-shape in cross section which is extended from the upper and lower outer surfaces of the protruded portions 3C to the inside of the extended space 5A of each front surface. In this case, the vertical portion of this L-shape injection inlet 21 extending to the upper and lower outer surfaces of the protruded portions 3C is formed as a screw bore 21*a*. After the coolant 6 is injected into the space 5, a screw with a resilient washer can be inserted into this screw bore 21*a* whereby to seal the injection inlet 21.

Reference numeral 22 designates a cut-out portion which is cut away through the upper side of the frame-shape portion 3A of the metal spacer 3 and served to extract to the outside of the effective picture screen a bubble produced in the liquid coolant 6 which is injected into the space 5.

Figure 12:
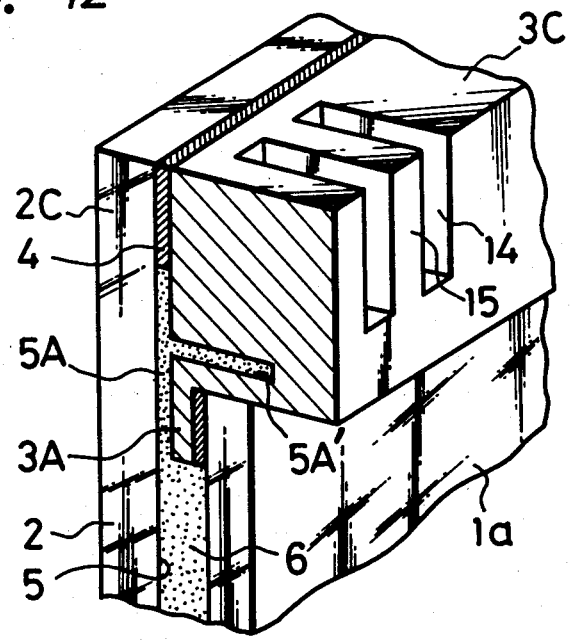
FIG. 12 is a partially cross-sectional perspective view of a main part of another embodiment according to this invention.

While in the above example the extended space 5A of the liquid tight space 5 is formed along the surface direction of the panel 2, it is needless to say that various modifications and variations can be made in which in some case, as shown in FIG. 12, a hollow portion 5A. which is extended in the direction perpendicular to the surface direction of the panel 2 is formed through the protruded portion 3C of the metal spacer 3 so as to form the cross section of T letter.

According to the construction of this invention as described above, the inner peripheral edge portion of the frame-shape portion 3A of the metal spacer 3 is immersed into the liquid coolant 6, which is located in contact with the front panel 1*a* of the cathode ray tube envelope 1, to be in contact therewith. Further, the space 5A is formed between the protruded portion 2C of the transparent panel 2 and particularly the protruded portion 3C of the metal spacer 3 and the liquid coolant is injected into such space so that the area in which the metal spacer 3 and the liquid coolant 6 contact with each other is increased and the contact area of the transparent panel 2 with the liquid coolant 6 is also increased. Thus, it is possible to increase the heat radiating area and the heat absorbing area formed by the metal spacer 3 and the front panel 2.

Since the protruded portion 2C is formed at least on the upper side edge of the panel 2, it is possible to effectively radiate the heat in the upper high temperature portion of the coolant 6 which is heated by the heat from the cathode ray tube envelope 1 and moved upwards.

While the protruded portion 2C is provided on the transparent panel 2, since this protruded portion 2C is selected to be the portion corresponding to the protruded portion 3C of the metal spacer 3 which constructs the heat radiating fin 15, the occupied space is not substantially increased as compared with the cathode ray tube apparatus as shown in FIGS. 1 and 2. Further, since the extended space 5A into which the liquid coolant 6 is injected is formed on the portion in which the fin 15 is formed as mentioned above, the distance between the coolant 6 and the heat radiating fin 15, accordingly, the heat radiating path is reduced in length so that the heat radiating effect can be enhanced more.

Figures 13, 14:
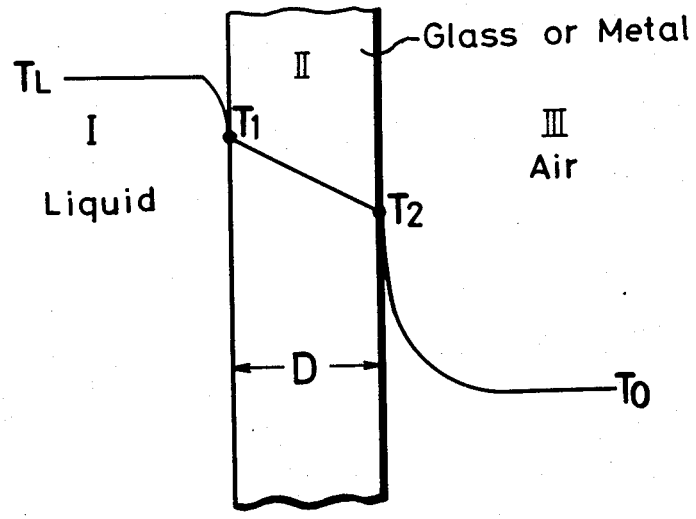
FIG. 13 is a table useful for explaining this invention and FIG. 14 is a diagram useful for explaining the effect of this invention.

FIG. 13 is a table indicating an average temperature $(\overline{T_L - T_0})$ of a difference between a temperature $T_L$ at each portion of the coolant 6 and a room temperature $T_0$ after 2 to 3 hours in a case where each of the prior art example, the comparative example having the constructions as shown in FIGS. 1 and 2 and the above embodiment of this invention is applied to a 5.5-inch type cathode ray tube and which is supplied with an electric power of 11.2W and the heat radiating areas and the heat absorbing areas of the transparent panel 2 and the metal spacer 3 in each example. As will be clear from this table, according to this invention, the temperature of the liquid coolant can effectively be lowered.

An outline of the mechanism in which the heat of the cooling liquid, namely, the liquid coolant 6 is radiated through the glass or metal to the air will be described. Now, as shown in FIG. 14, let it be assumed that the temperature on the surface of glass or metal (medium II) contacting with liquid (medium I) with temperature $T_L$° C. be $T_1$ and the temperature on the surface of this medium II contacting with the air (medium III) be $T_2$. In this case, when heat quantity q is flowed from the liquid to the glass or metal, an equation of heat can be expressed as:

$$q = h_L S_1 (T_L - T_1) \quad (1)$$

$$q = k \frac{T_1 - T_2}{D} S \quad (2)$$

$$q = h_{A1R} S_2 (T_2 - T_0). \quad (3)$$

where $h_L$ and $h_{AIR}$ are called thermal conductance coefficients of liquid and air and constants determined by physical properties of the liquid and air and the surface physical properties of the solid material contacting therewith.

Further, k is the thermal conductivity of glass or metal and $S_1$, S and $S_2$ respectively designate the contact area with the liquid, the cross-sectinnal area of a path of the solid material through which heat is conducted and the contact area with the air. D represents the length of the path of the solid material through which heat is conducted.

Modifying the equations (1), (2) and (3) yields $$T_L - T_1 = \frac{q}{h_L S_1} \quad (1)'$$

$$T_1 - T_2 = \frac{q}{kS} D \quad (2)'$$

$$T_2 - T_0 = \frac{q}{h_{A1R} S_2} \quad (3)'$$

Adding the equations (1)', (2)' and (3)' yields:

$$T_L - T_0 = q\left(\frac{1}{h_L S_1} + \frac{D}{kS} + \frac{1}{h_{A1R} S_2}\right) \quad (4)$$

$$\frac{1}{h_L S_1}, \frac{D}{kS} \text{ and } \frac{1}{h_{A1R} S_2}$$

indicated on the righthand sides of the equations (1)', (2)' and (3)' are called thermal resistances. If, now, these thermal resistances are expressed by Ri, the equation (4) can be expressed as $$T_L - T_0 = q\Sigma Ri \quad (4)'$$

where ΣRi represents the sum of thermal resistances. If, now, the heat radiating amount of the front panel is taken as $q_G$ and the heat radiating amount of the metal frame is taken as $q_M$, the sum Q of both the heat radiating amounts is given as $$Q = q_G + q_M \quad (5)$$

Thus, it is clear from the above equation (4) that when $T_L$ is constant, in order to increase the heat radiating amount, it is sufficient to make the thermal resistance small. On the contrary, when q is constant, in order to lower the temperature $T_L$ of the liquid, it is also sufficient to make the thermal resistance small.

Since the heat radiating amount from the transparent panel 2 and the metal spacer 3 is expressed by the equation (5), in order to lower the temperature of the whole of the liquid cooling closed convection type cathode ray tube, it is sufficient to reduce the thermal resistance of either of or both of the transparent panel 2 and the metal spacer 3. Alternatively, it is sufficient that the sum of both the thermal resistances be made small. As will be clear from the table of FIG. 13, as compared with the prior art example of FIG. 1, in the comparative example of FIG. 2, the thermal resistance of the transparent panel 2 is not changed but the heat absorbing area of the metal spacer 3 is increased so that the thermal resistance of the metal spacer 3 is lowered and hence the average temperature $\overline{(T_L - T_0)}$ of the liquid is lowered from 40° C. to 36° C. Further, comparing the above comparative example with the embodiment of the present invention, the heat radiating area of the metal spacer 3 is decreased, while the heat absorbing area thereof is increased. In this case, although it may be considered that the thermal resistance is not increased or decreased so much, the heat radiating area and the heat absorbing area of the transparent panel 2 are both increased with the thermal resistance being decreased clearly. As a result, according to the present invention, the total thermal resistance becomes small and the average temperature $\overline{(T_L - T_0)}$ of the liquid is lowered from 36° C. to 33° C.

We claim:

1. A liquid cooling type cathode ray tube apparatus comprising a cathode ray tube having a flat plate shaped front transparent panel on which a phosphor screen is deposited, a metal spacer provided on said front panel to surround said phoshor screen, said metal spacer serving as a heat radiator, and a separate flat plate shaped transparent panel disposed in opposing relation to said front panel of said cathode ray tube with a predetermined distance therebetween, wherein both of said panel and said spacer form a liquid tight space therebetween, a transparent liquid coolant is sealed in said space, said separate transparent panel is provided at least on its upper end side with a protruded portion which is protruded upwards from the upper marginal edge of said front panel wherein said protruded portion and said metal spacer form an extended space therebetween, said extended space being filled by said liquid coolant.

2. A liquid cooling type cathode ray tube apparatus according to claim 1, wherein a heat radiating fin is formed on an outer periphery of said metal spacer.

3. A liquid cooling type cathode ray tube apparatus according to claim 1, wherein said metal spacer is provided with an L-shape injection inlet of said liquid coolant which is formed of a first portion substantially in parallel to said front panel and a second portion communicated with said first portion and substantially perpendicular to said front panel.

* * * * *